US011537072B2

(12) United States Patent
Matsubara et al.

(10) Patent No.: US 11,537,072 B2
(45) Date of Patent: Dec. 27, 2022

(54) METHOD OF MANUFACTURING HEAT GENERATING ROLLER BY PROVIDING A POLY-ETHER-KETONE RESIN OVER A BASE MEMBER, HEAT GENERATING ROLLER, FIXING DEVICE, AND IMAGE FORMING APPARATUS

(71) Applicant: FUJIFILM Business Innovation Corp., Tokyo (JP)

(72) Inventors: Takashi Matsubara, Kanagawa (JP); Takashi Ohashi, Kanagawa (JP); Takuma Ishihara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/459,323

(22) Filed: Aug. 27, 2021

(65) Prior Publication Data

US 2022/0373946 A1 Nov. 24, 2022

(30) Foreign Application Priority Data

May 21, 2021 (JP) ..... JP2021-085910

(51) Int. Cl.
*G03G 15/20* (2006.01)

(52) U.S. Cl.
CPC ..... *G03G 15/2057* (2013.01); *G03G 15/2053* (2013.01); *G03G 2215/2003* (2013.01); *G03G 2215/2048* (2013.01)

(58) Field of Classification Search
CPC ..... G03G 15/2057; G03G 15/2053; G03G 2215/2003; G03G 2215/2048
See application file for complete search history.

(56) References Cited

FOREIGN PATENT DOCUMENTS

| | | | | |
|---|---|---|---|---|
| JP | 10-3226 A | | 1/1998 | |
| JP | 2000356919 A | * | 12/2000 | ..... G03G 15/2053 |
| JP | 2001-201970 A | | 7/2001 | |

OTHER PUBLICATIONS

Matsubara et al.—Fujifilm Business Innovation Corp., Japanese Application No. 2021-085909, Filing Date: May 21, 2021.*

* cited by examiner

*Primary Examiner* — Joseph S Wong
(74) *Attorney, Agent, or Firm* — Sughrue Mion, PLLC

(57) ABSTRACT

A method of manufacturing a heat generating roller includes forming an insulating portion on a surface of a metal base member by providing poly-ether-ether-ketone resin over the surface of the base member and heating the poly-ether-ether-ketone resin, the poly-ether-ether-ketone resin being electrically insulating and heat-shrinkable; and forming a heat generating portion on a surface of the insulating portion, the heat generating portion generating heat when energized.

11 Claims, 4 Drawing Sheets

METHOD OF MANUFACTURING HEAT GENERATING ROLLER BY PROVIDING A POLY-ETHER-KETONE RESIN OVER A BASE MEMBER, HEAT GENERATING ROLLER, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-085910 filed May 21, 2021.

BACKGROUND

(i) Technical Field

The present disclosure relates to a method of manufacturing a heat generating roller, a heat generating roller, a fixing device, and an image forming apparatus.

(ii) Related Art

Technologies disclosed by Japanese Unexamined Patent Application Publication No. 10-3226 ([0022] to [0025], FIG. 2) and Japanese Unexamined Patent Application Publication No. 2001-201970 ([0017] to [0021], FIG. 1) are publicly known as each relating to a fixing device of an image forming apparatus that fixes unfixed developer transferred to a medium.

Japanese Unexamined Patent Application Publication No. 10-3226 relates to a heat roller (10) including a roller body (11), a polyimide-resin insulating film (14) provided over the inner peripheral surface of the roller body (11), and a heating element (15) provided on the inner peripheral side of the insulating film (14).

Japanese Unexamined Patent Application Publication No. 2001-201970 relates to a thermal fixing roller (10) including a cylindrical core bar (1), an insulating layer (2) made of water-repellent resin such as fluorocarbon resin and provided over the inner peripheral surface of the core bar (1), and a resistance heating element (3) provided on the inner peripheral side of the insulating layer (2). The thermal fixing roller (10) according to Japanese Unexamined Patent Application Publication No. 2001-201970 further includes a toner-adhesion-preventing layer (4) provided on the outer peripheral side of the core bar (1). The toner-adhesion-preventing layer (4) is made of water-repellent resin such as fluorocarbon resin and serves as a release layer.

SUMMARY

Aspects of non-limiting embodiments of the present disclosure relate to achieving a film-thickness uniformity higher than that achieved by powder coating.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a method of manufacturing a heat generating roller that includes: forming an insulating portion on a surface of a metal base member by providing poly-ether-ether-ketone resin over the surface of the base member and heating the poly-ether-ether-ketone resin, the poly-ether-ether-ketone resin being electrically insulating and heat-shrinkable; and forming a heat generating portion on a surface of the insulating portion, the heat generating portion generating heat when energized.

BRIEF DESCRIPTION OF THE DRAWINGS

An exemplary embodiment of the present disclosure will be described in detail based on the following figures, wherein.

DETAILED DESCRIPTION

Figure 1:
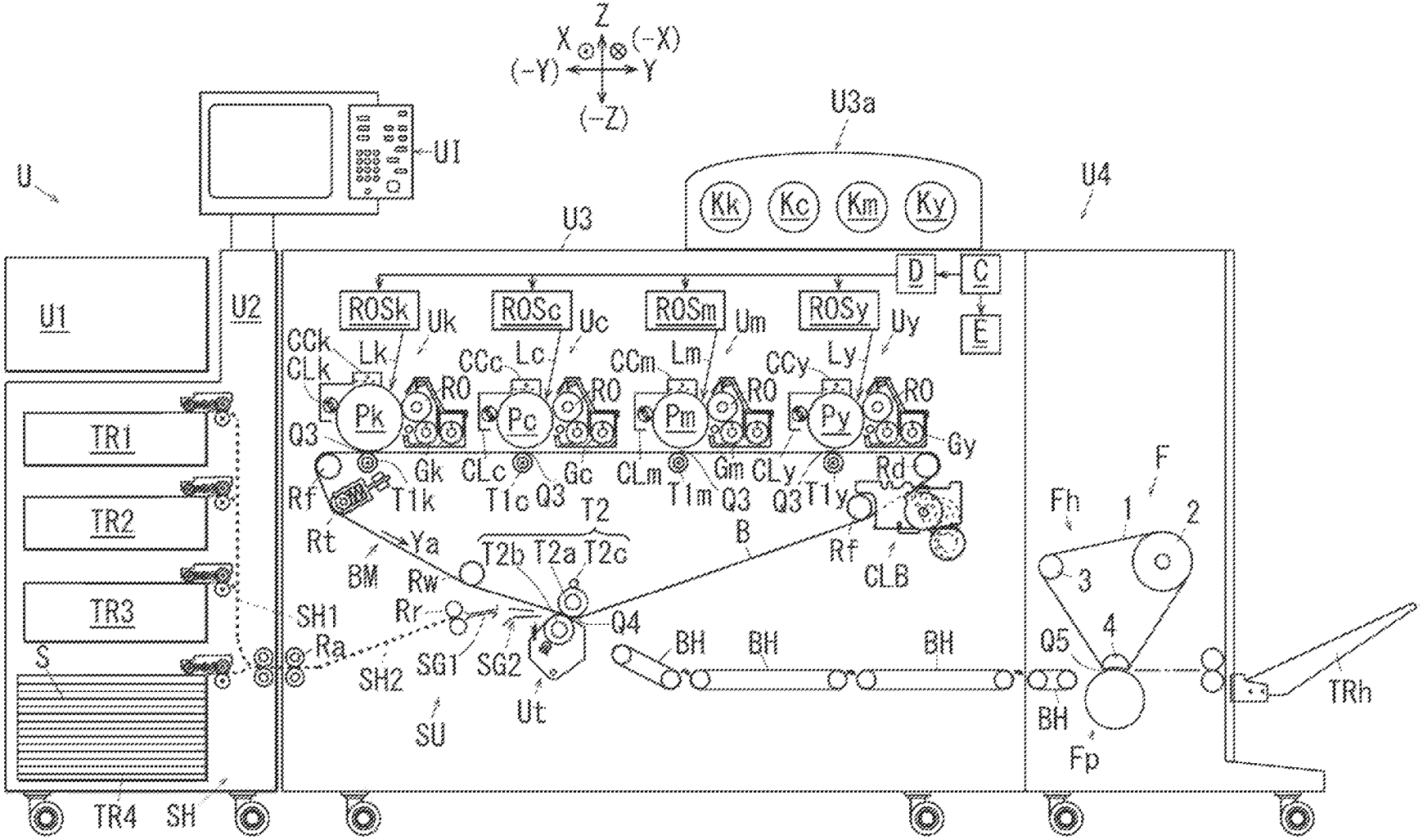
FIG. 1 illustrates the entirety of an image forming apparatus according to a first example of the present disclosure.

Specific examples of an exemplary embodiment of the present disclosure will now be described with reference to the accompanying drawings. Note that the present disclosure is not limited to the following examples.

To help understand the following description, the drawings are provided with an X axis representing the front-rear direction, a Y axis representing the horizontal direction, a Z axis representing the vertical direction, and arrows X, −X, Y, −Y, Z, and −Z representing the frontward, rearward, rightward, leftward, upward, and downward directions, respectively.

Furthermore, a circle with a dot is regarded as an arrow representing a direction from the back of the page toward the front of the page, and a circle with a cross is regarded as an arrow representing a direction from the front of the page toward the back of the page.

To help understand the following description, irrelevant elements are not illustrated in the drawings.

First Example

FIG. 1 illustrates the entirety of an image forming apparatus according to a first example of the present disclosure.

Referring to FIG. 1, a copying machine U is an exemplary image forming apparatus and includes an operation unit UI; a scanner device U1, which is an exemplary image reading device; a sheet feeding device U2; a printer unit U3, which is an exemplary image recording device; and a sheet output unit U4.

The operation unit UI includes a power button and various keys such as a copy start key, a copy-number-setting key, and a numerical keypad, which are all exemplary input portions. The operation unit UI further includes a display portion, and so forth.

The scanner device U1 reads a document (not illustrated), converts an image of the document into image information, and inputs the image information to the printer unit U3.

The sheet feeding device U2 includes a plurality of sheet feeding trays TR1 to TR4, which are exemplary sheet feeding units. The sheet feeding trays TR1 to TR4 each contain recording sheets S, which are each an exemplary medium. A sheet feeding path SH1, which is an exemplary transport path for the medium, extends from the sheet feeding trays TR1 to TR4 to the printer unit U3.

The printer unit U3, illustrated in FIG. 1, includes a controller C, a power circuit E, and so forth. The power circuit E is controlled by the controller C and supplies power to relevant elements of the printer unit U3. The controller C receives the image information representing the document that is read by the scanner device U1, or image information that is transmitted from a personal computer serving as an exemplary information transmitting device (not illustrated) connected to the copying machine U.

The controller C processes the received image information into pieces of printing information for yellow Y, magenta M, cyan C, and black K and outputs the pieces of printing information to a laser driving circuit D, which is an exemplary driving circuit for a latent-image-writing device. The laser driving circuit D receives a laser driving signal from the controller C and outputs with a predetermined timing the laser driving signal to exposure devices ROSy, ROSm, ROSc, and ROSk, which are exemplary latent-image-forming components for the respective colors.

Image carrier units Uy, Um, Uc, and Uk for the respective colors of Y, M, C, and K are provided below the respective exposure devices ROSy, ROSm, ROSc, and ROSk.

Referring to FIG. 1, the image carrier unit Uk for black K includes a photoconductor drum Pk, which is an exemplary image carrying component; a charging corotron CCk, which is an exemplary charging component; and a photoconductor cleaner CLk, which is an exemplary cleaning component for the image carrying component. The image carrier units Uy, Um, and Uc for the other colors of Y, M, and C also include respective photoconductor drums Py, Pm, and Pc; respective charging corotrons CCy, CCm, and CCc; and respective photoconductor cleaners CLy, CLm, and CLc.

In the first example, the photoconductor drum Pk for the color K, which tends to be used frequently and therefore wears fast, has a larger diameter than the photoconductor drums Py, Pm, and Pc for the other colors. Correspondingly, the photoconductor drum Pk is rotatable faster and is given a longer life than the others.

The photoconductor drums Py, Pm, Pc, and Pk are uniformly charged by the respective charging corotrons CCy, CCm, CCc, and CCk and are then irradiated with respective laser beams Ly, Lm, Lc, and Lk, which are exemplary latent-image-writing rays, emitted from the respective exposure devices ROSy, ROSm, ROSc, and ROSk, whereby electrostatic latent images are formed on the respective photoconductor drums Py, Pm, Pc, and Pk. The electrostatic latent images thus formed on the photoconductor drums Py, Pm, Pc, and Pk are developed into toner images in the respective colors of yellow Y, magenta M, cyan C, and black K by respective developing rollers RO, which are exemplary developing members, included in respective developing devices Gy, Gm, Gc, and Gk, which are exemplary developing components.

The toner images on the photoconductor drums Py, Pm, Pc, and Pk are sequentially transferred to an intermediate transfer belt B, which is an exemplary intermediate transfer component or an exemplary image carrying component, in respective first transfer areas Q3 by respective first transfer rollers T1*y*, T1*m*, T1*c*, and T1*k*, which are exemplary first transfer components. The toner images thus transferred are superposed one on top of another, whereby a multicolor image, or a so-called color image, is formed on the intermediate transfer belt B. The color image thus formed on the intermediate transfer belt B is transported to a second transfer area Q4.

If the image information contains black image data alone, only the photoconductor drum Pk and the developing device Gk for black K are used, whereby only a black toner image is formed.

After the above first transfer, residual toner particles on the photoconductor drums Py, Pm, Pc, and Pk are removed by the respective photoconductor cleaners CLy, CLm, CLc, and CLk.

Combinations of the image carrier units Uy, Um, Uc, and Uk and the respective developing devices Gy, Gm, Gc, and Gk are regarded as toner-image-forming members Uy+Gy, Um+Gm, Uc+Gc, and Uk+Gk, and serve as exemplary visual-image-forming portions.

The printer unit U3 is provided at the top thereof with a toner dispenser U3*a*, which is an exemplary supply component. Toner cartridges Ky, Km, Kc, and Kk are exemplary developer containing components and are detachably attached to the toner dispenser U3*a*. When toners in the respective developing devices Gy, Gm, Gc, and Gk are consumed with an image forming operation, fresh toners in the respective toner cartridges Ky, Km, Kc, and Kk are supplied to the respective developing devices Gy, Gm, Gc, and Gk.

The intermediate transfer belt B is provided below the photoconductor drums Py, Pm, Pc, and Pk and is stretched around the following: an intermediate driving roller Rd, which is an exemplary driving component for the intermediate transfer component; an intermediate tension roller Rt, which is an exemplary tension applying component that applies a tension to the intermediate transfer belt B; an intermediate steering roller Rw, which is an exemplary first skew correcting component that corrects any skew or meandering of the intermediate transfer belt B; a plurality of intermediate idler rollers Rf, which are exemplary follower components; and a backup roller T2*a*, which is an exemplary counter component provided in the second transfer area Q4. The intermediate transfer belt B thus supported is rotatable in a direction of arrow Ya with the activation of the intermediate driving roller Rd.

A combination of the intermediate driving roller Rd, the intermediate tension roller Rt, the intermediate steering roller Rw, the intermediate idler rollers Rf, the backup roller T2*a*, the first transfer rollers T1*y*, T1*m*, T1*c*, and T1*k*, the intermediate transfer belt B, and other relevant elements is regarded as a belt module BM, which is an exemplary intermediate transfer device. The belt module BM according to the first example is an exchangeable unit that is detachable from the printer unit U3.

A second transfer unit Ut serves as an exemplary transfer-transporting component and is provided below the backup roller T2*a*. The second transfer unit Ut includes a second transfer roller T2*b*, which is an exemplary transfer member.

The second transfer roller T2*b* is positioned across from the backup roller T2*a*. The area where the second transfer roller T2*b* faces the intermediate transfer belt B is regarded as the second transfer area Q4. The backup roller T2*a* is provided with a contact roller T2*c*, which is in contact therewith. The contact roller T2*c* is an exemplary contact component for voltage application. The contact roller T2*c* receives a second transfer voltage, which is applied with a preset timing from the power circuit E controlled by the controller C. The polarity of the second transfer voltage is the same as the polarity of toner charging.

A combination of the rollers T2*a* to T2*c* is regarded as a second transfer device T2, which is as an exemplary second transfer component. A combination of the intermediate transfer belt B, the first transfer rollers T1*y*, T1*m*, T1*c*, and T1*k*, the second transfer device T2, and other relevant elements is regarded as a transfer device B+T1+T2, which is an exemplary transfer component.

A sheet transport path SH2 runs below the belt module BM. A recording sheet S fed from the sheet feeding path SH1 in the sheet feeding device U2 is transported to the sheet transport path SH2 by transporting rollers Ra, which are exemplary transporting components. The recording sheet S in the sheet transport path SH2 is forwarded by a registration roller Rr, which is an exemplary forwarding component, synchronously with the timing of the toner image's reaching the second transfer area Q4. The recording sheet S is then guided by sheet guides SG1 and SG2, which are exemplary medium guiding components, and is transported to the second transfer area Q4.

The toner images on the intermediate transfer belt B are transferred to the recording sheet S by the second transfer device T2 when passing through the second transfer area Q4. In the case of a color image, the toner images superposed one on top of another on the intermediate transfer belt B in the first transfer are transferred to the recording sheet S at a time in the second transfer.

The intermediate transfer belt B having undergone the second transfer is cleaned by a belt cleaner CLB, which is an exemplary cleaning component for the intermediate transfer component.

The recording sheet S having the toner images second-transferred thereto is transported to medium transporting belts BH, which are exemplary transporting components. The medium transporting belts BH transport the recording sheet S to a fixing device F. The fixing device F, which is an exemplary fixing component, includes a heating unit Fh, which is an exemplary heating component; and a pressing roller Fp, which is an exemplary pressing component. The heating unit Fh and the pressing roller Fp are positioned face to face with each other and in contact with each other in an area serving as a fixing area Q5.

The toner images on the recording sheet S are thermally fixed by the fixing device F when passing through the fixing area Q5. The recording sheet S having the toner images thus fixed by the fixing device F is outputted to an output tray TRh, which is an exemplary output portion.

A combination of the sheet feeding path SH1, the sheet transport path SH2, and other relevant paths is regarded as a sheet transport path SH. A combination of the sheet transport path SH, the transporting rollers Ra, the registration roller Rr, the sheet guides SG1 and SG2, the medium transporting belts BH, and other relevant elements is regarded as a sheet transporting device SU.

Description of Fixing Device

Referring to FIG. 1, the heating unit Fh of the fixing device F according to the first example includes an endless fixing belt 1, which is an exemplary belt component. The fixing belt 1 according to the first example is supported by a heat generating roller 2, which is an exemplary heat generating member; a driving roller 3, which is an exemplary driving component; and a fixing pad 4, which is an exemplary counter component. The heat generating roller 2 generates heat and thus heats the fixing belt 1 in the image forming operation. The driving roller 3 rotates the fixing belt 1 in the image forming operation. The fixing pad 4 brings the fixing belt 1 to face the pressing roller Fp in the fixing area Q5.

Description of Heat Generating Roller

Figure 2:
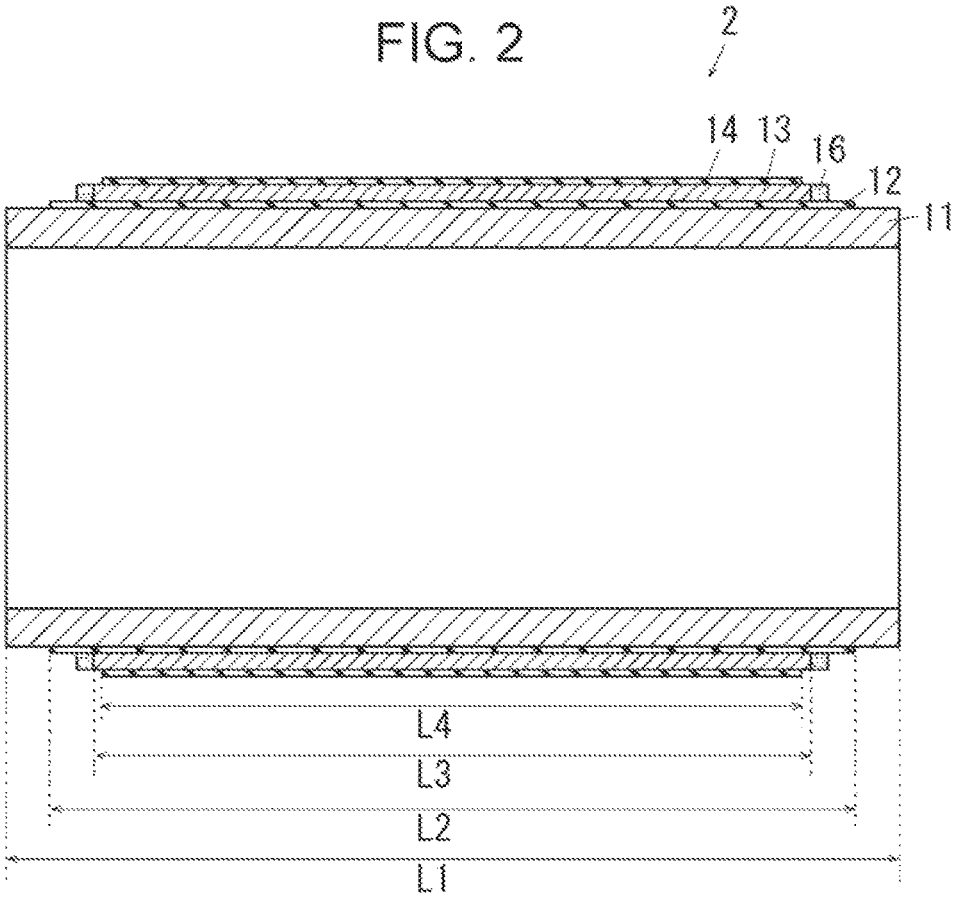
FIG. 2 schematically illustrates a heat generating roller according to the first example.

FIG. 2 schematically illustrates the heat generating roller 2 according to the first example.

Figure 3:
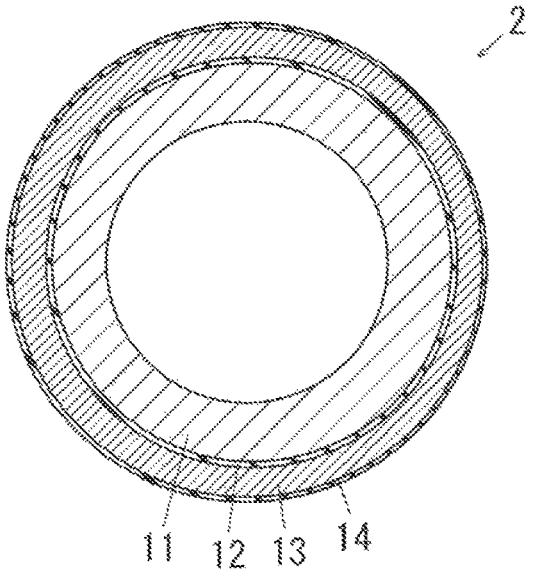
FIG. 3 is a sectional view of the heat generating roller according to the first example, illustrating relevant elements thereof.

FIG. 3 is a sectional view of the heat generating roller 2 according to the first example, illustrating relevant elements thereof.

Referring to FIGS. 2 and 3, the heat generating roller 2 according to the first example includes a core bar 11, which is an exemplary base member. The core bar 11 according to the first example is made of an electrically conductive metal material. The core bar 11 is preferably made of aluminum, for example, but may be made of iron or an electrically conductive alloy such as stainless steel. The core bar 11 according to the first example has a cylindrical shape elongated in the rotation axis direction thereof.

An insulating layer 12, which is an exemplary insulating portion, is provided over the outer periphery of the core bar 11. The insulating layer 12 according to the first example is made of poly-ether-ether-ketone (PEEK) resin, which is an exemplary material that is electrically insulating and whose water absorption, or water content, is lower than that of polyimide resin. Water absorption is measured by immersing a sample in water at 23° C. for 24 hours, in accordance with a Japanese Industrial Standard JIS K 7209. For example, PEEK resin has a water absorption of 0.04%, polyimide resin has a water absorption of 0.8%, polyamide resin has a water absorption of about 0.4%, polyamide imide resin has a water absorption of about 0.3%, and perfluoroalkoxy alkane resin (PFA), which is an exemplary fluorocarbon resin, has a water absorption of 0.01%.

A heat generating layer 13, which is an exemplary heat generating portion, is provided over the outer surface of the insulating layer 12. The heat generating layer 13 is a resistance heating element that generates heat when energized. The resistance heating element is publicly known as disclosed by, for example, Japanese Unexamined Patent Application Publication No. 10-3226 or No. 2001-201970 and is not described in detail herein.

A surface layer 14, which is an exemplary outer layer, is provided over the outer surface of the heat generating layer 13.

The surface layer 14 according to the first example is desirably made of an insulating material for the following reason. If the surface layer 14 is made of an electrically conductive material, an electric current from the heat generating layer 13 easily flows through the surface layer 14, leading to a problem such as an increase in the capacity of the power circuit E, leakage of the electric current to the fixing belt 1, or the like. Therefore, the surface layer 14 is desirably made of an electrically insulating material. Examples of the electrically insulating material include polyimide resin, glass resin, PEEK resin, fluorocarbon resin, polyamide resin, polyimidoamide resin, poly-ether-ketone-ketone (PEKK) resin, and the like.

The surface layer 14 according to the first example is desirably made of a wear-resistant material in view of resistance to wear caused by the contact with the fixing belt 1. Examples of the wear-resistant material include polyimide resin, glass resin, PEEK resin, and fluorocarbon resin.

In view of the efficiency of heat transmission to the fixing belt 1, the surface layer 14 according to the first example desirably has a lower thermal resistance than the insulating layer 12. The thermal resistance is expressed as thermal conductivity times thickness. The smaller the thermal resistance, the greater the ease of heat transmission. Therefore, considering that the heat generating layer 13 is held between the insulating layer 12 and the surface layer 14, it is desirable that the surface layer 14, which is closer to the fixing belt 1, have a lower thermal resistance than the insulating layer 12. Hence, if the surface layer 14 is made of PEEK resin as with the insulating layer 12, the thermal resistance of the surface layer 14 may be reduced by setting the thickness of the surface layer 14 smaller than the thickness of the insulating layer 12.

Referring to FIG. 2, the lengths of the layers included in the heat generating roller 2 according to the first example in the rotation axis direction are set as follows: L1>L2>L3≥L4, in which L1 denotes the length of the core bar 11, L2 denotes the length of the insulating layer 12, L3 denotes the length of the heat generating layer 13, and L4 denotes the length of the surface layer 14. The length L1 of the core bar 11 is the longest. The heat generating layer 13 is provided at each of the two axial ends thereof with silver paste 16 for power feeding.

Description of Method of Manufacturing Heat Generating Roller

Figure 4A:
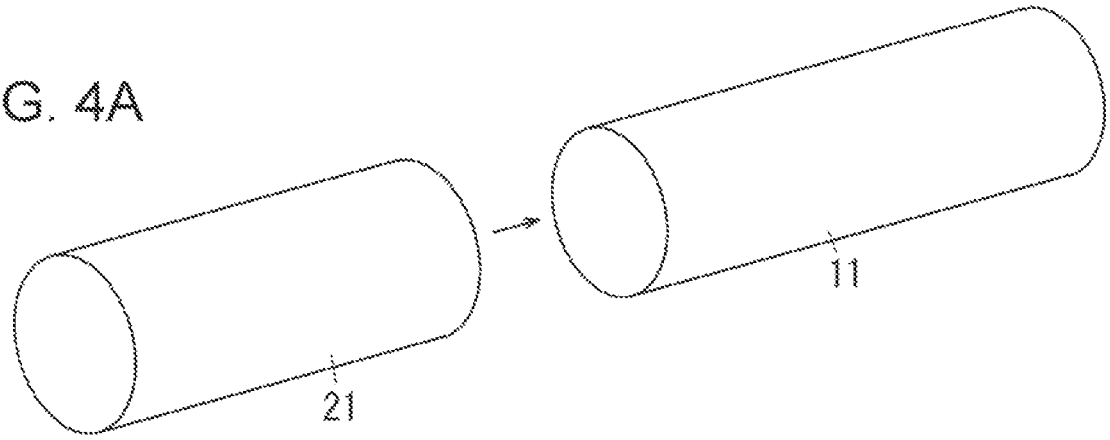
FIG. 4A illustrates a step included in a method of manufacturing the heat generating roller according to the first example and in which PEEK resin is yet to be provided over a base member.
Figure 4B:
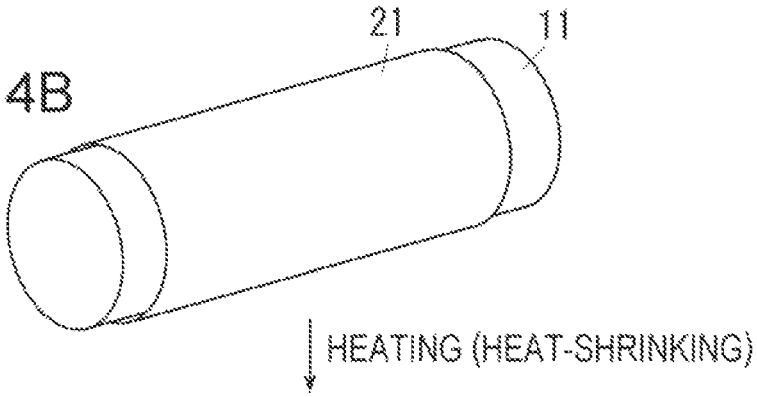
FIG. 4B illustrates a step subsequent to the step illustrated in FIG. 4A and in which the PEEK resin is provided over the base member.
Figure 4C:
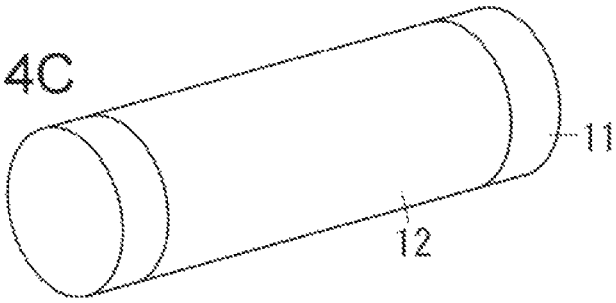
FIG. 4C illustrates a step subsequent to the step illustrated in FIG. 4B and in which the PEEK resin is heat-shrunk.
Figure 4D:
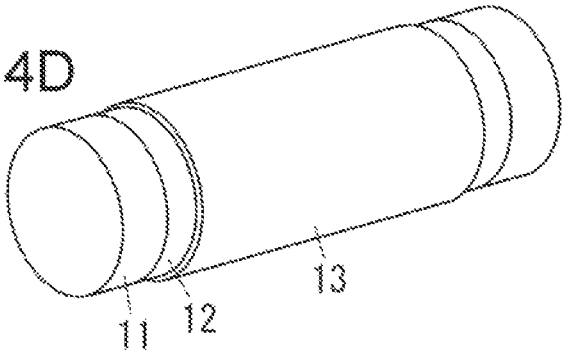
FIG. 4D illustrates a step subsequent to the step illustrated in FIG. 4C and in which a heat generating portion fixedly is provided over the PEEK resin.

FIGS. 4A to 4D illustrate a method of manufacturing the heat generating roller 2 according to the first example. FIG. 4A illustrates a step in which PEEK resin is yet to be provided over a base member. FIG. 4B illustrates a step subsequent to the step illustrated in FIG. 4A and in which the PEEK resin is provided over the base member. FIG. 4C illustrates a step subsequent to the step illustrated in FIG. 4B and in which the PEEK resin is heat-shrunk. FIG. 4D illustrates a step subsequent to the step illustrated in FIG. 4C and in which a heat generating portion is fixedly provided over the PEEK resin.

To manufacture the heat generating roller 2 according to the first example, as illustrated in FIG. 4A, a cylindrical body 21 is prepared. The cylindrical body 21 is made of PEEK resin and has an inside diameter greater than the outside diameter of the core bar 11. The cylindrical body 21 is obtained by extrusion molding in which bulk (solid) PEEK resin is heated to 200° C. or higher and is extruded into a cylindrical shape. In the process of forming the cylindrical body 21 from the bulk PEEK resin, the body of PEEK resin is widened while being cooled. Thus, the hardened cylindrical body 21 has a residual stress or strain. The cylindrical body 21 thus having a residual strain shrinks when reheated. The shrinkage rate of the cylindrical body 21 is greater in the radial direction than in the lengthwise direction (axial direction). Furthermore, in view of assured insulation, the thickness of the cylindrical body 21 is preferably about 10 μm to 50 μm, more preferably about 30 μm.

Referring to FIG. 4B, the cylindrical body 21 is provided over the core bar 11, and the cylindrical body 21 and the core bar 11 are heated to 160° C. or higher. When the core bar 11 and the cylindrical body 21 are heated, the cylindrical body 21 shrinks with the heat and closely fits the core bar 11 to serve as the insulating layer 12, as illustrated in FIG. 4C.

Subsequently, as illustrated in FIGS. 4C and 4D, the heat generating layer 13 is fixedly provided over the insulating layer 12. If the surface layer 14 is further provided, the surface layer 14 is formed by heat-shrinking a cylindrical body, as with the case of the insulating layer 12, or by another method such as coating. Thus, the heat generating roller 2 is obtained.

Features of First Example

In the copying machine U according to the first example that is configured as above, when an image forming operation is started, the heat generating layer 13 is energized and generates heat, with which the heat generating roller 2 heats the fixing belt 1, whereby the fixing area Q5 is heated to a predetermined fixing temperature. In this state, the recording sheet S passing through the fixing area Q5 is heated, whereby the toners are fixed.

A heat generating roller, such as the one according to the first example or Japanese Unexamined Patent Application Publication No. 10-3226 or No. 2001-201970 employing the heat generating layer 13 or a sheet-type or film-type resistance heating element, requires an insulating layer that electrically insulates the resistance heating element and the core bar from each other, as in the first example or in Japanese Unexamined Patent Application Publication No. 10-3226 or No. 2001-201970. If the insulating layer is made of polyimide as in Japanese Unexamined Patent Application Publication No. 10-3226, water contained in the polyimide, which has a high water absorption or water content, expands when heated. Consequently, the insulating layer may come to have an irregular surface, which leads to nonuniformity in the heating or fixing performance. The nonuniformity in the fixing performance may be eased with the use of an insulating layer made of fluorocarbon resin, which has a low water content, as in Japanese Unexamined Patent Application Publication No. 2001-201970. However, fluorocarbon resin exhibits a high releasablility. That is, when a heat generating layer is made to adhere to such an insulating layer exhibiting a low wettability or adhesiveness, the adhesion of the heat generating layer may be nonuniform, resulting in nonuniformity in the thickness of the set of layers included in the heat generating roller. Therefore, if the insulating layer is made of fluorocarbon resin, the uniformity in the quality and thickness of the insulating layer may be reduced, leading to nonuniformity in the fixing performance.

In view of the above, the heat generating roller 2 according to the first example employs the insulating layer 12 made of PEEK resin, which is electrically insulating, has a low water absorption, and is highly wettable or adhesive with respect to the heat generating layer 13 and other relevant elements.

Furthermore, in the first example, the surface layer 14 is made of an insulating material.

Furthermore, in the first example, the surface layer 14 is made of a wear-resistant material.

Furthermore, in the first example, the surface layer 14 has a lower thermal resistance than the insulating layer 12.

Furthermore, in the first example, the lengths L1 to L4 of the core bar 11, the insulating layer 12, the heat generating layer 13, and the surface layer 14 in the axial direction are set as follows: L1>L2>L3≥L4. If L2<L3, the insulation between the core bar 11 and the heat generating layer 13 is insufficient. If L3<L4, the power feeding to the heat generating layer 13 is difficult.

In the first example, the insulating layer 12 is obtained by providing the cylindrical body 21 (a tubular body) over the core bar 11 and heat-shrinking the cylindrical body 21 to fix the cylindrical body 21 to the core bar 11. In the related art, a typical coating method to form a PEEK film is powder coating. Specifically, a film made of PEEK resin is formed from PEEK particles having diameters of about 10 μm to 50 μm. In some cases, dry PEEK particles are sprayed and are then baked. In other cases, a fluid dispersed with PEEK particles is applied and is then baked. However, if an insulating layer 12 with a thickness of 30 μm to 50 μm is formed from PEEK particles having diameters of 10 μm to 50 μm, the finished insulating layer 12 may have an irregular surface, making it difficult to achieve a uniform thickness. Consequently, the thicknesses of the heat generating layer 13 and the surface layer 14 to be provided over the insulating layer 12 may be adversely affected. Such a problem may be eased by increasing the thickness of the insulating layer 12. However, if the thickness of the insulating layer 12 is increased, the amount of PEEK material to be used increases, which increases the material cost. Furthermore, the heat capacity of the heat generating roller 2 as a whole increases. Consequently, it takes a long time to heat the heat generating roller 2 to the predetermined temperature. Correspondingly, it takes a long time before the image forming operation is started.

In view of the above, in the first example, the insulating layer 12 is obtained by heat-shrinking the cylindrical body 21.

Furthermore, in the first example, the shrinkage rate of the cylindrical body 21 is smaller in the axial direction than in the radial direction. If the shrinkage rate of the cylindrical body 21 is greater in the axial direction, the cylindrical body 21 heat-shrinks to a greater extent in the axial direction, which tends to result in a wrinkled insulating layer 12. In view of the above, in the first example, the shrinkage rate of the cylindrical body 21 is greater in the radial direction.

Second Example

A second example of the present disclosure will now be described. In the following description of the second example, elements corresponding to those described in the first example are denoted by corresponding ones of the reference signs, and detailed description of such elements is omitted.

The second example is basically the same as the first example, except the following.

Figure 5:
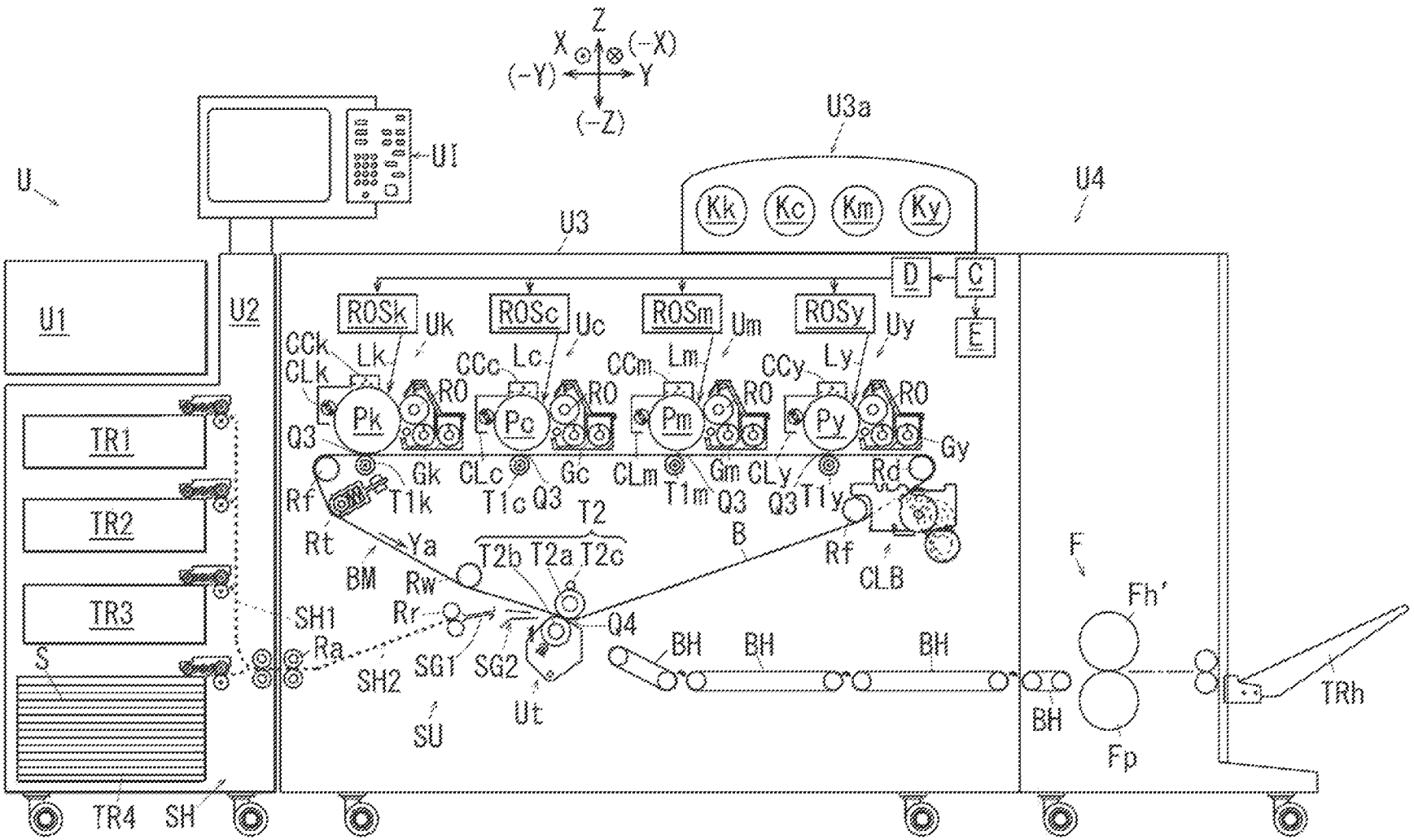
FIG. 5 illustrates an image forming apparatus according to a second example and corresponds to FIG. 1 illustrating the first example.

FIG. 5 illustrates an image forming apparatus according to the second example and corresponds to FIG. 1 illustrating the first example.

Referring to FIG. 5, a heating component Fh' included in a copying machine U according to the second example differs from the heating unit Fh according to the first example. The heating component Fh' is a heating roller Fh', which is an exemplary heat generating roller. The heating roller Fh' according to the second example includes the core bar 11, the insulating layer 12, and the heat generating layer 13 as with the heat generating roller 2 according to the first example. The heating roller Fh' according to the second example further includes a surface layer 14', which is different from the surface layer 14 according to the first example. The surface layer 14' according to the second example is made of fluorocarbon resin, which exhibits a high releasability.

Features of Second Example

The heating roller Fh' according to the second example that is configured as above directly faces the pressing roller Fp. The insulating layer 12 of the heating roller Fh' is made of PEEK resin. In particular, the surface layer 14', which directly comes into contact with the unfixed toners on the recording sheet S, is made of fluorocarbon resin, which exhibits a high releasability.

Modifications

While some examples of the present disclosure have been described in detail above, the present disclosure is not limited to the above examples. Various changes may be made to the above examples within the scope of the present disclosure defined by the appended claims. Modifications (H01) to (H09) of the present disclosure are as follows.

(H01) While the above examples each concern a copying machine serving as an exemplary image forming apparatus, the image forming apparatus is not limited thereto and may be, for example, a facsimile, a printer, or a multifunction machine.

(H02) While the above examples each concern an image forming apparatus to be used with developers having four respective colors, the image forming apparatus is not limited thereto. For example, a monochrome image forming apparatus and another multicolor image forming apparatus to be used with developers having three or less colors or five or more colors are also applicable.

(H03) While the above examples each concern a configuration in which the insulating layer 12 is directly provided over the core bar 11 and the heat generating layer 13 is directly provided over the insulating layer 12, the configuration is not limited thereto. For example, another layer may be interposed between the insulating layer 12 and the heat generating layer 13. The layer to be interposed between the insulating layer 12 and the heat generating layer 13 may be a primer layer obtained by applying primer for improving wettability or adhesiveness.

(H04) The surface layer 14 according to the first example may be omitted.

(H05) The surface layer 14, which is desirably made of an insulating material in the first example, may be made of an electrically conductive material.

(H06) The surface layer 14, which is desirably made of a wear-resistant material in the first example, may be made of a material that tends to wear easily if, for example, priority is given to releasability.

(H07) The surface layer 14, which desirably has a low thermal resistance in the first example, may have a high thermal resistance.

(H08) The lengths L1 to L4 of the layers in the axial direction that are set as described in each of the above examples may be arbitrarily changed in accordance with the design, specifications, or the like.

(H09) The above examples each concern a case where the insulating layer 12 is obtained from the cylindrical body 21, the insulating layer 12 is not limited thereto. For example, the insulating layer 12 may be obtained by wrapping a thin film of PEEK resin around the core bar 11 and heat-shrinking the thin film to make the thin film closely fit the core bar 11. Note that such an insulating layer 12 obtained by wrapping a film around the core bar 11 has a seam. In this respect, the use of the cylindrical body 21 is preferable.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A method of manufacturing a heat generating roller, the method comprising:

forming an insulating portion on a surface of a metal base member by providing poly-ether-ether-ketone resin over the surface of the base member and heating the poly-ether-ether-ketone resin, the poly-ether-ether-ketone resin being electrically insulating and heat-shrinkable; and forming a heat generating portion on a surface of the insulating portion, the heat generating portion generating heat when energized.

2. The method of manufacturing a heat generating roller according to claim 1, wherein the poly-ether-ether-ketone resin has a cylindrical shape.

3. The method of manufacturing a heat generating roller according to claim 2, wherein the poly-ether-ether-ketone resin having the cylindrical shape has a smaller heat shrinkage rate in a lengthwise direction than in a radial direction.

4. A heat generating roller comprising:

a base member made of metal;

a heat generating portion made of a material that generates heat when energized; and an insulating portion provided between the base member and the heat generating portion and that electrically insulates the base member and the heat generating portion from each other, the insulating portion being obtained by providing a cylinder of poly-ether-ether-ketone resin over the base member and fixing the cylinder to the base member by heat-shrinking the cylinder.

5. A fixing device comprising:

a heating component including the heat generating roller according to claim 4; and a pressing component positioned face to face with the heating component, wherein the fixing device fixes developer provided on a medium that passes through a position between the heating component and the pressing component.

6. The fixing device according to claim 5, wherein the heating component further includes an endless belt component running through an area that faces the pressing component, the belt component being supported and heated by the heat generating roller, and wherein the medium having the developer to be fixed passes through a position between the belt component and the pressing component.

7. The fixing device according to claim 5, wherein the heat generating roller is positioned face to face with the pressing component.

8. An image forming apparatus comprising:

an image carrying component;

a latent-image-forming component that forms a latent image on the image carrying component;

a developing component that develops the latent image on the image carrying component into an image;

a transfer component that transfers the image on the image carrying component to a medium; and the fixing device according to claim 5 that fixes the image on the medium.

9. The method of manufacturing a heat generating roller according to claim 1, wherein the surface of the base member over which the poly-ether-ether-ketone resin is provided has a cylindrical shape.

10. The method of manufacturing a heat generating roller according to claim 1, wherein the insulating portion is formed on the surface of a metal base member by causing the poly-ether-ether-ketone resin to shrink by the heating of the poly-ether-ether-ketone resin.

11. The heat generating roller according to claim 1, wherein the base member over which the poly-ether-ether-ketone resin is provided has a cylindrical shape.

* * * * *